United States Patent [19]

Hillinger

[11] Patent Number: 4,462,441

[45] Date of Patent: Jul. 31, 1984

[54] QUARTERING EDGE

[75] Inventor: George Hillinger, Los Angeles, Calif.

[73] Assignee: Alltrade Inc., Commerce, Calif.

[21] Appl. No.: 464,824

[22] Filed: Feb. 8, 1983

[51] Int. Cl.[3] ..... B27L 7/00

[52] U.S. Cl. ..... 144/193 D; 145/1 R; 254/104

[58] Field of Search ..... 144/193 R, 193 C, 193 D; 254/104; 145/1 R

[56] References Cited

U.S. PATENT DOCUMENTS

| | | | |
|---|---|---|---|
| 165,984 | 7/1875 | Cosbey | 254/104 |
| 1,032,316 | 7/1912 | Walters | 254/104 |
| 1,380,559 | 6/1921 | Jespersen | 254/104 |

FOREIGN PATENT DOCUMENTS

| | | | |
|---|---|---|---|
| 185266 | 4/1956 | Austria | 144/193 D |

*Primary Examiner*—W. D. Bray

*Attorney, Agent, or Firm*—William W. Glenny

[57] ABSTRACT

A splitter wedge construction for selectively halving or quartering a workpiece such as a log including a first wedge having an upper anvil head and vertical elongated shank terminating in a downwardly directed cutting edge, the shank being provided with an elongated slot for receiving the central section of a second wedge having a downwardly directed cutting edge, the cutting edges of the two wedges when assembled being mutually perpendicular. Retaining spring pins are provided for removably retaining the two wedges loosely in assembled relation, with abutment faces of the two wedges in abuttable relation when force is applied to the anvil head.

4 Claims, 5 Drawing Figures

QUARTERING EDGE

BACKGROUND AND SUMMARY OF THE INVENTION

This invention relates generally to a wedge for splitting logs, and more particularly to such a wedge for, selectively, halving or quartering logs.

Many splitter wedges have been provided in the past, some for actuation by a hand pounding tool such as a maul, and others for use with power machinery for providing the necessary force. Instances of the hand tool actuated devices are shown in the following U.S. Pat. Nos.: Manning 1,261,834; Courville 3,515,372; and Lavigne 4,209,046. Instances of the mechanized type are shown in the following U.S. Pat. Nos.: Van Slyke 1,307,714 and Butas 3,974,867.

The present invention distinguishes over the prior art in providing a splitter wedge which permits the user to use the wedge for either halving or, selectively, quartering a log or other workpiece. Thus the preferred form of the invention disclosed herein includes a first wedge member having a downwardly directed cutting edge, by preference provided with chamfered end portions. The shank of the first wedge member has formed therein a longitudinally extending central opening or enlarged slot, defined upwardly by a horizontal flat abutment face. In accordance with the invention there is provided a second wedge member having a body including a central portion receivable in the slot and having an upwardly directed abutment face, the central portion including a pair of coplanar downwardly directed cutting edges. Retaining means are provided by which to selectively retain the second wedge member in assembled relation with the first wedge member, the retaining means being designed to permit the second member to move upwardly relative to the first until the abutment faces of the two wedge members are in contact. In this way, downward force applied to the first wedge member will be transmitted to the second wedge member during splitted operation through abutting contact between the two wedge members, and none of that force is applied to the retaining means.

Accordingly, the principal object of the present invention is to provide a novel improved splitter wedge construction. Additional objects are to provide, in such a device, a construction permitting the user to employ the device either for halving or for quartering a workpiece such as a log; a construction in which two wedge members are readily assemblable and disassemblable; a construction in which, when assembled, one wedge member is permitted only limited movement relative to the other; and for other and additional purposes as will be understood from a reading of the following description of a preferred form of the invention, taken in connection with the accompanying drawings.

DETAILED DESCRIPTION

Figure 1:
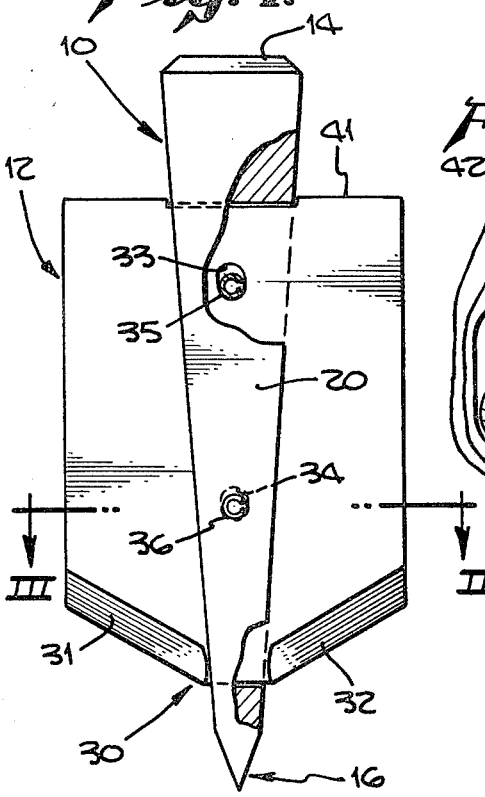
FIG. 1 is a front elevational view of a splitter wedge embodying the present invention.
Figure 2:
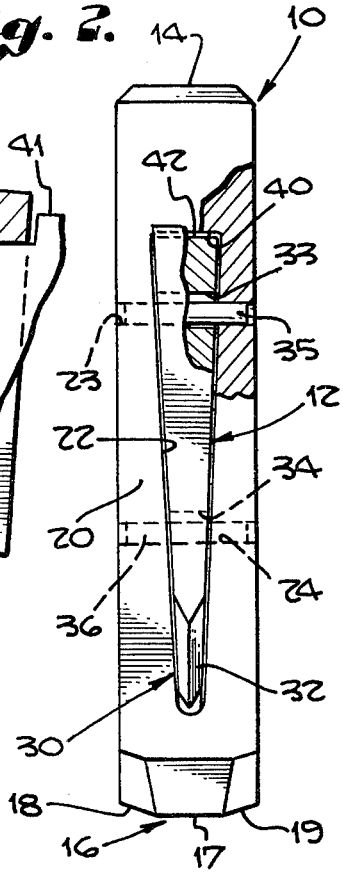
FIG. 2. is a side elevational view of the wedge.
Figure 3:
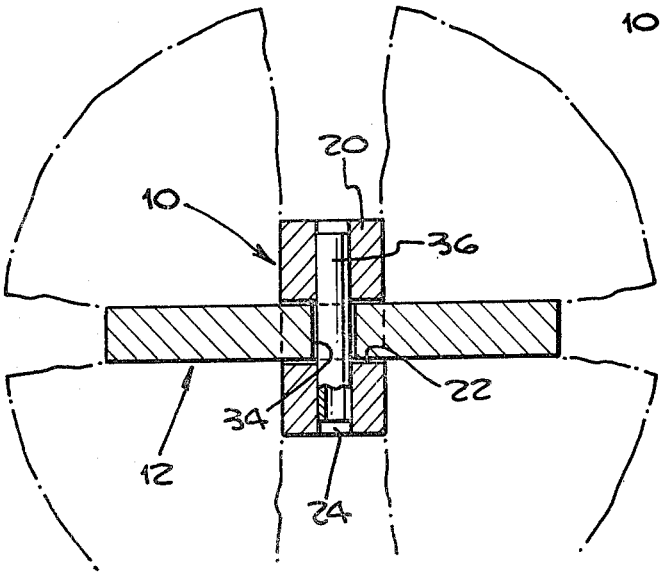
FIG. 3 is a sectional view looking downwardly on the arrows III—III of FIG. 1, with a portion of a log being quartered shown in dotted outline.
Figure 4:
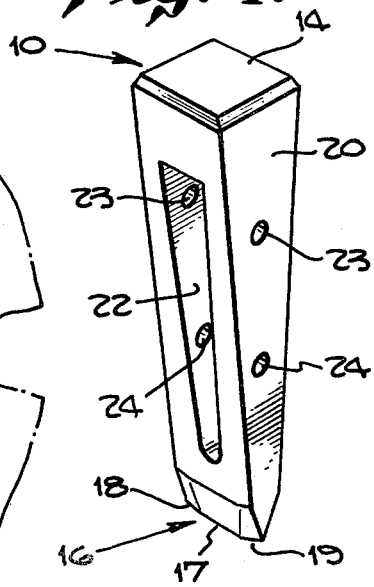
FIG. 4 is a perspective view of the principal wedge member.

The splitter wedge shown in FIG. 1 includes first and second wedge members indicated generally at 10 and 12 respectively. As seen in FIG. 4, the first wedge member has a head 14 at its upper end for receiving downward force during operation, such as the impact of a maul. At its lower end wedge member 10 has a cutting edge indicated generally at 16 lying in the central vertical plane of the wedge member. The cutting edge, as best seen in FIG. 2, has a straight central section 17 generally perpendicular to the longitudinal axis of the wedge member, and flanking chamfered sections 18 and 19 to facilitate initial penetration of a workpiece such as a log.

The shank 20 of wedge member 10 is provided with an elongated opening or slot 22, as well as with a pair of vertically spaced horizontal bores 23 and 24 extending transversely of the shank on either side of the slot.

Second wedge member 12 is provided with a downwardly directed bifurcated lower cutting edge indicated generally at 30 including edge sections 31 and 32, desirably chamfered upwardly as shown. Wedge member 12 is also provided, centrally of its body, with upper and lower vertically elongated slots 33 and 34 which are in registration with bores 23 and 24 when the two wedge members are in their assembled relation as seen in FIG. 1. Means are provided for retaining the wedge members in that assembled relation, here shown as a pair of spring split pins 35 and 36 which fit tightly in bores 23 and 24, but loosely in slots 33 and 34.

The elongated slot 22 of the first wedge member 10 is bounded upwardly by a downwardly directed abutment face 40, and the upper surface 41 of second wedge member 12 includes a central portion 42, which may be slightly recessed as shown, constituting an upwardly directed abutment face.

Figure 5:
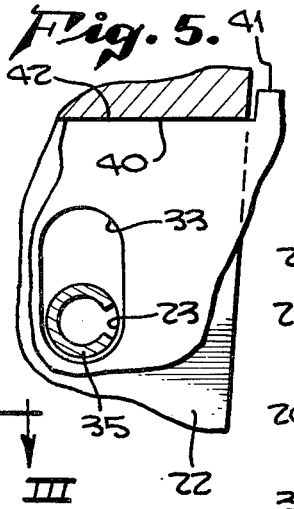
FIG. 5 is a fragmentary view on an enlarged scale of the upper broken away portion of FIG. 1, with the parts shown in their relative positions during actual use of the wedge.

In operation, downward force on upper face 14 is applied not only to first cutting edge 16, but also, through abutting contact of faces 40 and 42, to cutting edge 30. In order to avoid damage to retaining spring pins 35 and 36, it is important that the pins fit loosely in slots 33 and 34, and also that those slots extend far enough downwardly so that their lower arcs do not contact the pins during operation, as best seen in the enlarged view FIG. 5. Thus, as there shown, abutment faces 40 and 42 are in contact, but there is arcuate clearance between pin 35 and the lower arc of slot 33.

It will thus be seen that there is here provided a versatile splitter wedge, adapted for either halving or quartering a workpiece. Retaining pins 35 and 36 are readily inserted or removed by well known means such as a drift pin or the like. Modifications and changes not departing from the spirit of the invention are intended to be embraced within the scope of the accompanying claims.

What is claimed is:

1. A splitter wedge generally symmetrical about a central plane and comprising a vertically extending elongated shank having an upper generally flat head constituting an anvil and a downwardly directed cutting edge lying in said plane, the shank having formed therethrough an elongated vertically extending transverse slot, and a second wedge member having a downwardly directed cutting edge, the second wedge including a central section received in said slot.

2. The invention as defined in claim 1 wherein the cutting edges of the two wedges are mutually perpendicular.

3. The invention as defined in claim 1 wherein the slot is bounded upwardly by a downwardly directed abutment face formed on the first named wedge, and the central section of the second wedge is provided with an upwardly directed abutment face in abuttable relation with the first wedge abutment face.

4. The invention as defined in claim 1 including means for loosely retaining said central section in the slot.

* * * * *

UNITED STATES PATENT AND TRADEMARK OFFICE

CERTIFICATE OF CORRECTION

PATENT NO. : 4,462,441

DATED : July 31, 1984

INVENTOR(S) : George Hillinger

It is certified that error appears in the above-identified patent and that said Letters Patent is hereby corrected as shown below:

On the title page, Item [54] and column 1, line 2, "QUARTERING EDGE" should read -- QUARTERING WEDGE --.

Signed and Sealed this

*Twenty-fifth* Day of *December 1984*

[SEAL]

*Attest:*

*Attesting Officer*

GERALD J. MOSSINGHOFF

*Commissioner of Patents and Trademarks*